United States Patent [19]

Weinhart et al.

[11] 3,961,381

[45] June 8, 1976

[54] ONE-PIECE SAFETY, SLATLESS, BED RAIL ASSEMBLY

[76] Inventors: Maurice Weinhart, 18620 Ardmoor, Detroit, Mich. 48235; Walter Weinhart, 29500 W. Nine Mile Road, Farmington Hills, Mich. 48024

[22] Filed: June 17, 1974

[21] Appl. No.: 479,753

[52] U.S. Cl. ..... 5/296; 5/286; 5/238

[51] Int. Cl.[2] ..... A47C 19/04

[58] Field of Search ..... 5/296, 286, 279 B, 238

[56] References Cited

UNITED STATES PATENTS

| | | | |
|---|---|---|---|
| 2,845,636 | 8/1958 | Iaquinta et al. | 5/296 X |
| 3,118,151 | 1/1964 | Fredman | 5/286 X |
| 3,761,970 | 10/1973 | Fredman | 5/296 |

*Primary Examiner*—Robert L. Wolfe
*Assistant Examiner*—Andrew M. Calvert
*Attorney, Agent, or Firm*—Gifford, Chandler & Sheridan

[57] ABSTRACT

The invention relates to a one piece bed rail assembly and method of making the same whereby the bed rail is stamped from a flat piece of high quality metal or from any other sturdy material and then bent to form the hook portions on the ends of the rail for engaging the head board and foot board, and a horizontal flange for supporting the box springs.

1 Claim, 7 Drawing Figures

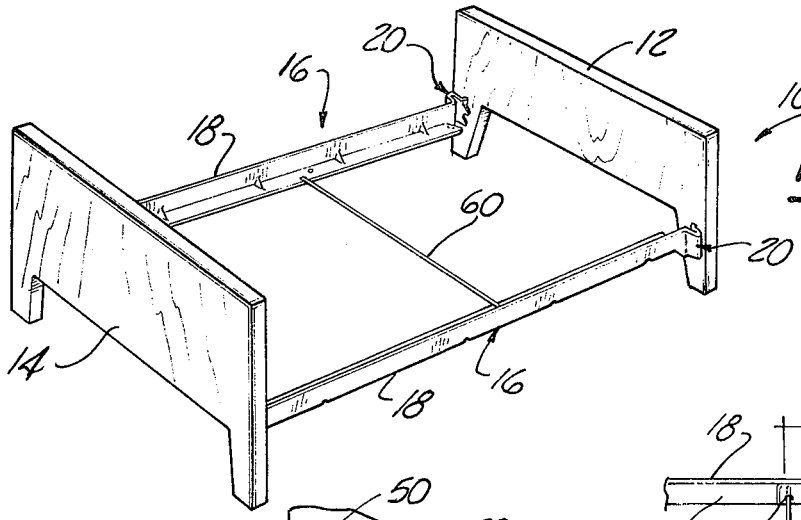
Fig-1
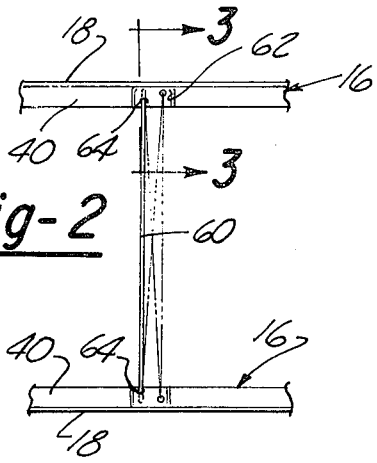
Fig-2
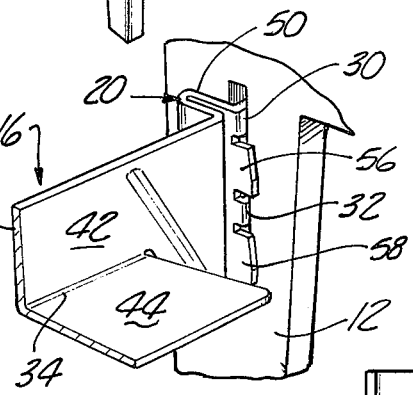
Fig-7
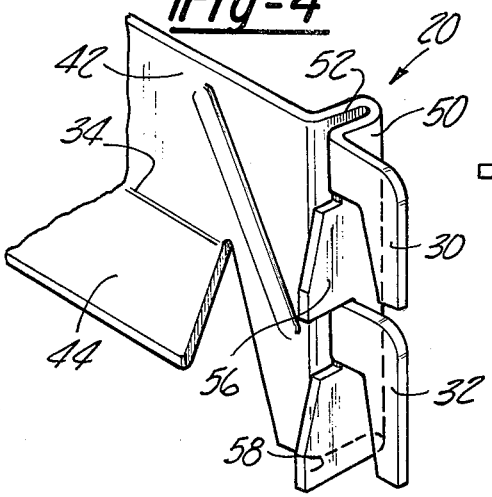
Fig-4
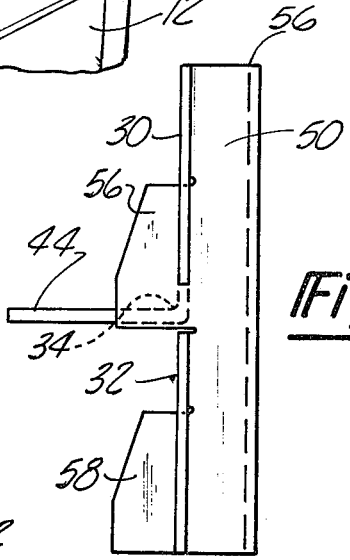
Fig-5
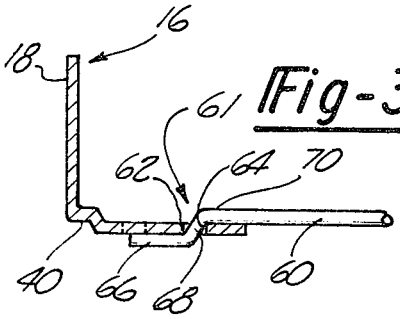
Fig-3
Fig-6
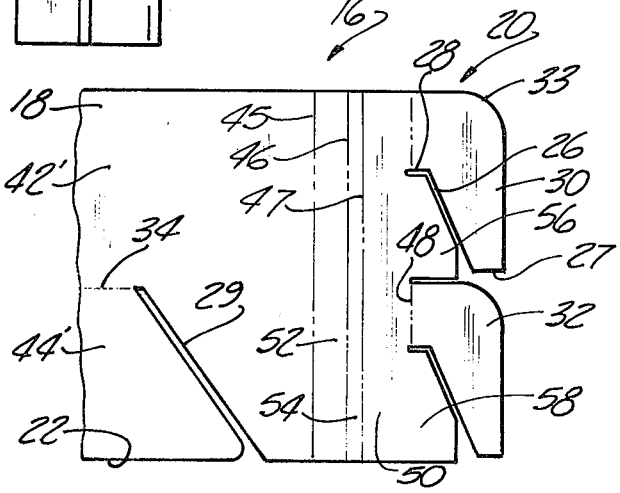

ONE-PIECE SAFETY, SLATLESS, BED RAIL ASSEMBLY

DESCRIPTION OF THE PRIOR ART

I. Field of the Invention

The present invention relates to bed rail assemblies and more particularly to a one-piece bed rail assembly.

II. Prior Art

In the prior art of bed rail construction and manufacture, an elongated right-angle metallic section forms the midsection and support for the bed slats which in turn support the box springs and mattress of the bed in an elevated position. Connection fittings, generally comprising a pair of hook members disposed in a vertical plane and adapted to engage receiving slots in the headboard and footboard, are typically fastened to each end of the bed rail by rivets, welding or the like.

The prior art method of fastening the connection fittings to the bed rail suffers many disadvantages unlike the present invention. The primary disadvantage of welding, riveting, etc. the connection fittings to the bed rail is that this type of construction is very expensive. Multiple stamping and other manufacturing steps are necessary in order to produce the several component parts required for a completed bed rail assembly. Expensive machinery and ever increasing labor costs are required for each manufacturing step thereby greatly increasing labor costs of bed rails. These manufacturing costs are consequently greatly increased when complex manufacturing processes, such as welding and riveting processes, are required to assemble the bed rail.

A further disadvantage to the prior art bed rails is that the fastener or fastening process utilized between the bed rail and the connection fittings may become loose and fail thereby requiring replacement or, at the very least, expensive repair of the bed rail assembly.

SUMMARY OF THE PRESENT INVENTION

The present invention overcomes the above mentioned disadvantages of the prior art by providing a single piece bed rail assembly wherein the bed rails are integral with the end connection fittings thereby eliminating the complex and expensive manufacturing steps of fastening the bed rail to the connection fittings. In the preferred embodiment, the bed rail assembly is stamped from a flat one-piece of high quality steel. The bed rail, i.e. the elongated mid portion of the stamped bed rail assembly, is then bent into substantially a right angle near the center of its longitudinal axis to form a horizontal support surface for the box spring. A pair of hooks on the ends of the bed rail assembly, which have been cut in outline form during the stamping operation, are then bent so that the hooks remain generally parallel to the plane of the bed rail but the portions of the bed rail assembly both between and immediately rearward of the hooks are bent substantially perpendicular to the plane of the hook thereby forming a double shoulder along each side of the bed rail hooks to abut against the headboard or footboard.

In the preferred embodiment of the invention, the box spring is supported directly by the inwardly protruding, much wider, horizontal flanges of the bed rails which cradles and supports the full length along both sides of the box spring, rather than many wood slats as is common in the prior art. In order to prevent the bed rails from bowing outwardly and dropping the box springs, a rigid wire is securely but removably, fastened between the bed rails at their midpoints thereby providing additional support for the bottom of the box spring and simply and effectively preventing the bed rails from bowing outwardly.

BRIEF DESCRIPTION OF THE DRAWINGS

The present invention will be more clearly understood when described in conjunction with the attached drawing, wherein like reference characters refer to like parts throughout the several views and in which:

FIG. 1 shows an elevated perspective view of the assembled bed frame of the present invention;

FIG. 2 is a top partial perspective view of the bed rail assembly;

FIG. 3 is a partial cross sectional view taken along line 3—3 of FIG. 2;

FIG. 4 is an elevated partial perspective view particularly illustrating the end connection fitting of the present invention;

FIG. 5 is a perspective view taken along line 5—5 of FIG. 4;

FIG. 6 is a front partial perspective view showing the connection fitting of the present invention prior to bending the connection fitting into its final form; and FIG. 7 is an enlarged fragmentary view of the structure shown in FIG. 1.

DETAILED DESCRIPTION OF THE PREFERRED EMBODIMENT

Referring now to FIG. 1, the bed frame 10 generally comprises a headboard 12, a footboard 14 and side rail assemblies 16. The side rail assemblies 16, only one of which will be described in detail since both are substantially identical, are disposed in a manner to be hereinafter described between the headboard 12 and footboard 14 in a longitudinally spaced parallel relationship with the side rail assemblies 16 facing each other.

The bed rail assemblies 16 are of one piece construction, but for ease of description, comprise an elongated bed rail 18 and opposing connection fittings 20 on each end of the rail 18. Since each opposing connection fitting 20 is a mirror image of the other, only one connection fitting 20 will be described in detail.

Referring now to FIG. 6, a number of bed rail assemblies 16, (although only one is shown) are preferably cut from a single sheet of metal with one rail assembly 16 disposed under another so that the bottom cutting line 22 of rail assembly 16 also forms the top cutting line of the next lower rail assembly 16. In this manner it is easily seen that not only is the number of cutting lines on the metal sheet minimized but also that metal wastage is kept to a bare minimum thereby resulting in increased savings in the costs of manufacture.

In the preferred method of manufacture, several bed rail assemblies 16 are stamped from the metal sheet in a single stamping operation. The stamping pattern for one end of the bed rail assembly 16, illustrated in FIG. 6, generally comprises a pair of hooks 30 and 32. The hooks 30 and 32 are of conventional design for bed rail assemblies and comprise a rounded upper corner 33 and a lower edge 26 which is acutely angled towards the center of the bed rail assembly with respect to the longitudinal axis of the bed rail assembly 16. The lower end of edge 26 terminates at the end 27, which may be flat or rounded, of the hook 30 or 32, while the upper end of edge 26 terminates at a short cut line 28 which is generally parallel to the longitudinal axis of the rail assembly 16. A final cut line 29 in the bed rail 18 is positioned just leftward of the connection fitting 20 as shown in FIG. 6. Cut line 29 preferably extends approximately halfway across the rail 18 from the bottom cut line 22 and is angled inwardly towards the center of the rail assembly 16.

It should be recognized however, that cutting methods other than stamping may be used to cut the rail assemblies 16 from the metal without departing from the scope of the invention although stamping is the preferred mode.

After the bed rail assemblies 16 have been stamped from the metal sheet, the bed rail 18 is divided into an upper leg 42' and lower leg 44' by a line 34 running lengthwise along the bed rail 18 between the upper ends of cut lines 29. The lower leg 44' is then inwardly bent, relative to the completed bed frame, to substantially a right angle with the upper leg 42', thus forming an integral vertical leg 42 and a horizontal leg 44 as best shown in FIG. 4. The horizontal leg 44 thus formed will support the box springs in a manner to be later described.

Again referring to FIG. 6, four vertical lines 45–48 define three vertical metal strips, 50, 52, and 54. The central strip 54 is then bent or stamped outwardly relative to the completed bed frame 10 to form a substantially U-shaped vertical channel 56 (FIG. 4) having parallel sides 50 and 52 substantially perpendicular to the plane of the vertical leg 42 of the bed rail 18 and likewise perpendicular to the plane defined by the hooks 30 and 32. The U-shaped channel 56 terminates at its outer side along line 48 and along line 45 at its inner side.

When the U-shaped channel is formed as described above, a pair of tabs 56 and 58, which originally form the portions between the hooks 30 and 32 during the stamping operation, are integral with the vertical strip and one side 50 of the U-shaped channel 56. Thus when the channel 56 is bent or stamped to the shape shown in FIG. 4, as described above, the tabs 54 and 56 simultaneously bend inwardly in the same plane as side 50 of channel 56 and hence are substantially perpendicular to hooks 30 and 32. In this manner the tab 54 and 56 in conjunction with side 50 of the U-shaped channel 56 form a double shoulder, i.e. one shoulder on each side of the hooks 30 and 32, in planes perpendicular thereto, to hold the bed rails flush against the headboard and footboard thereby eliminating all play on the conventional pins inside of the head and footboards when the bed frame is assembled. This can best be seen in FIG. 7. The base or bottom 54 of the U-shaped channel 56 also provides an additional safety feature by eliminating all sharp corners at the connection fittings 20 after the bed frame is assembled, thereby eliminating the common place cuts and scrapes which result from bumping into the bed rail.

In the preferred embodiment of the present invention, the completed bed frame does not utilize wood slats to support the box springs (not shown) but rather the box springs are supported by the inwardly protruding horizontal legs 44 of the bed rails 18. A common problem associated with supporting the box springs by the bed rails, without the use of slats, is that the bed rails have a tendency to bow outwardly, thus dropping the box springs and mattress to the floor.

The present invention provides means for prohibiting the bed rails from bowing outwardly by securely attaching a solid wire 60 between the bed rails 18 approximately in the center of the bed frame. As best shown in FIGS. 2 and 3, a pair of spaced holes 62 and 64 are drilled, stamped, or otherwise formed along the traverse centerline of the horizontal leg 44 of the bed rail 18. The hole 62 is preferably formed nearer to the vertical leg 42 of the bed rail 18 while conversely the hole 64 is preferably spaced away from the vertical leg 42 towards the outer edge of the horizontal leg 44.

The end 61 of the wire 60 is generally S-shaped and comprises an outer portion 66, midportion 68 and inner portion 70. As best shown in FIG. 3, the outer and midportions 66 and 68 of the wire end 61 are inserted through hole 62 or 64 so that the wire end outer portion 66 abuts against the bottom surface of the horizontal leg 44 of the bed rail 18 while the inner portion 70 of the wire end 61 abuts against the upper surface of the horizontal leg 44. The mid portion 68 of the end 61 of the wire 60 is thus locked into the hole 62 as against an axial movement or force on the wire 60. If the bed rails 18 begin to bow outwardly, the wire midportion 68 will abut against the inner surface of the hole 62 or 64 and effectively prevent further bowing of the bed rails 18 and, simultaneously prevent unintended release of the box springs. It will be appreciated that the opposite end of the wire 60 is similarly locked into the second bed rail assembly 16.

The two holes 62 and 64 are provided in the bed rail 18 to allow for tolerance variations in the box spring and bed post dimensions. For example, if the bed rails 18 are too narrowly spaced to accommodate the box springs after inserting the wire 60 through holes 62 in each bed rail, the wire 60 may be inserted through one or both holes 64 in order to permit a slightly wider spacing of the bed rails 18. It will also be appreciated that the wire 60 is produced in different lengths to accommodate different sizes of bed frames, e.g. single beds, double beds, and the like. In addition, as best shown in FIG. 3, the horizontal leg of the bed rail 18 is preferably indented downwardly around the holes 62 and 64 so that the top of the wire 60 is flush with the top surface of the horizontal leg 44 of the rail 18 to permit the box springs to rest flatly upon the horizontal legs 44 of the bed rails 18. The wire 60 extending across the space between the bed rails 18 provides additional support for the bottom of the box spring.

The construction of the bed frame is as follows: One rail assembly 16 is connected to both the headboard and footboard by inserting the hooks 30 and 32 in receiving slots in the head and footboards in the conventional manner. The angled lower edge 26 of the hooks 30 and 32 engage over the upper surface of pins (not shown) in the headboard 12 and footboard 14 and urge the tabs 56 and 58 and the side 50 of the U-shaped channel 56 to rest flush against the headboard and footboard. The wire 60 is then inserted through the holes 62 or 64 in both bed rails after which the second rail assembly 16 is fastened to the headboard and footboard in the same manner as the first rail assembly 16. The box spring is then placed upon the upper surface of the horizontal legs 44 of the two rail assemblies 16 and upon the wire 60. The mattress is finally placed upon the box springs and the bed is completed.

Although only a single embodiment of the present invention has been described, many modifications may be made by those skilled in the art without departing from the spirit of the invention as defined by the scope of the appended claims.

What is claimed is:

1. A bed rail assembly comprising a pair of one piece rails; each of said rails comprising an elongated member having an upper vertical flange and a lower horizontal flange and a pair of connection fittings, one of said fittings disposed on each end of said member each connection fitting comprising a pair of outwardly and downwardly extending hooks, one of said hooks disposed under the other hook in a spaced relationship wherein both hooks are parallel to the plane of said vertical flange, and a vertical U-shaped channel having one edge along the base of said hooks wherein the side of said channel immediately adjacent said hooks is substantially perpendicular to the plane of the hooks, a pair of tabs wherein each of said tabs is integral with the last mentioned side of the U-shaped channel and is substantially perpendicular to the plane of the hooks, and wherein the tabs lie on one side of the plane of the hooks and the U-shaped channel lies in the other side of the plane of the hooks to thereby define a shoulder on each side of said hooks extending in a plane substantially perpendicular to the plane of said hooks, a pair of apertures formed in each of said members in spaced relationship and a support member having end portions receivable in one of said apertures in each of said members whereby the distances between said rails can be adjusted depending upon which apertures in said rail are utilized.

* * * * *